United States Patent [19]

Karkoska

[11] 4,026,554

[45] * May 31, 1977

[54] FOOTBALL GOAL POSTS WITH MESSAGE MATRIX

[75] Inventor: George E. Karkoska, Berwyn, Ill.

[73] Assignee: G.E.K. Enterprises, Inc., Chicago, Ill.

[ * ] Notice: The portion of the term of this patent subsequent to Dec. 24, 1991, has been disclaimed.

[22] Filed: Dec. 23, 1974

[21] Appl. No.: 536,001

Related U.S. Application Data

[63] Continuation-in-part of Ser. No. 378,796, Aug. 8, 1973, Pat. No. 3,856,302.

[52] U.S. Cl. ..... 273/55 R

[51] Int. Cl.[2] ..... A63B 67/00

[58] Field of Search ..... 273/55 R, 1 ES; 340/323; 272/3

[56] References Cited

UNITED STATES PATENTS

| | | | |
|---|---|---|---|
| 2,884,252 | 4/1959 | Thompson | 273/55 R |
| 3,602,504 | 8/1971 | Chapman | 273/55 R X |
| 3,638,215 | 1/1972 | Payne | 340/323 X |
| 3,675,922 | 7/1972 | Nieland | 273/55 R |
| 3,856,302 | 12/1974 | Karkoska | 273/55 R |

*Primary Examiner*—Richard C. Pinkham
*Assistant Examiner*—T. Brown
*Attorney, Agent, or Firm*—Charles M. Chadd

[57] ABSTRACT

A football goal post is provided wherein the U-shaped target portion consisting of the cross-bar and uprights is attached to one end of an elongated boom. The other end of the boom is pivotably connected to a ground anchored vertical support member so that the U-shaped target can be raised out of position when it is not needed. Also provided within the uprights is a photocell field for properly registering the passage of a football through the target. The goal post support member has mounted thereon a computer-programmed vertical reading message matrix including rows of lights to form desired messages.

2 Claims, 5 Drawing Figures

FIG. 1
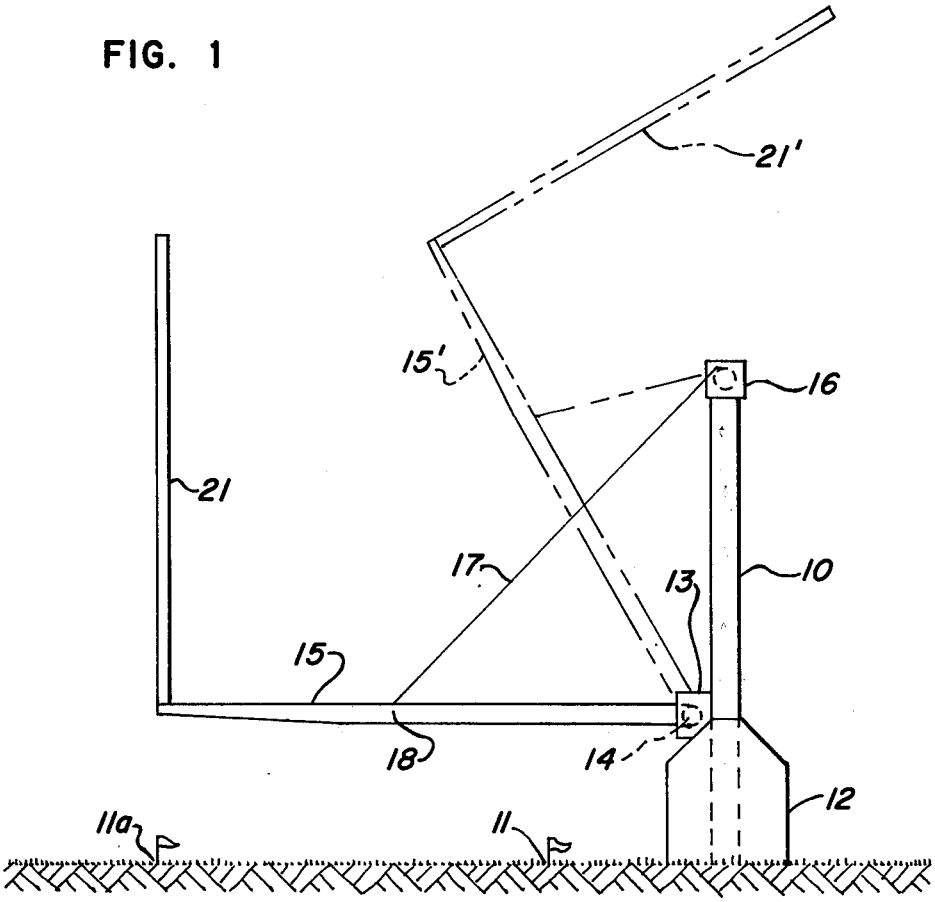
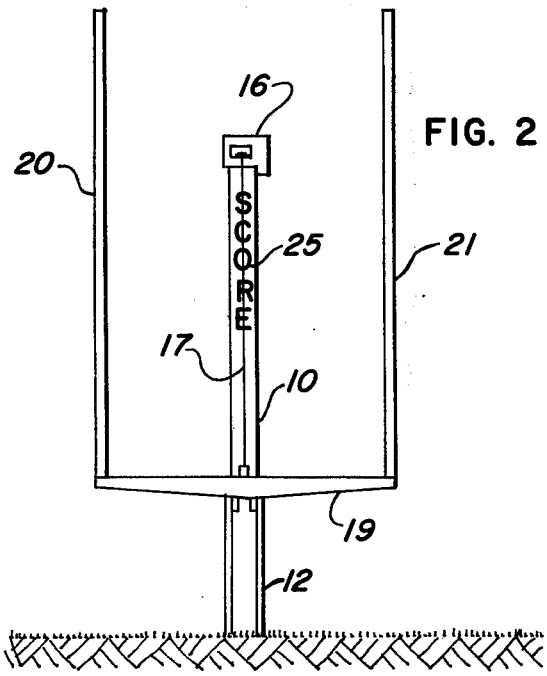
FIG. 2
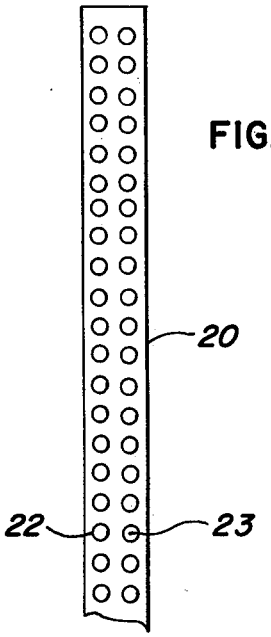
FIG. 3

FOOTBALL GOAL POSTS WITH MESSAGE MATRIX

BACKGROUND AND SUMMARY OF THE INVENTION

This application is a continuation-in-part of my copending application Ser. No. 378,796, filed Aug. 8, 1973 now U.S. Pat. No. 3,856,302.

This invention relates to football goal posts and eliminates their tendency to be both a safety hazard to the player and an obstruction to the flow of the game.

A goal post is used as a scoring target for field goals and extra points in a football game. The conventionally used goal post consists of a U-shaped target comprising a horizontal cross-bar and two vertical uprights located at the opposite ends of the horizonatal cross-bar, and a ground-anchored vertical member affixed to the U-shaped scoring target to support it at a fixed, pre-determined vertical distance above the ground.

A football playing field is laid out so as to include a goal line which represents the touchdown scoring marker and an end-zone extending for ten yards behind the goal line. The end-zone is part of the playing field and the area behind the end-zone is out-of-bounds. A substantial amount of play during a game takes place in the end-zone area.

In professional football, the goal post is constructed so as to have its ground-anchored vertical support member located in the end-zone two or three yards behind the goal line and its cross-bar and uprights located in a vertical plane extending upward from the goal line. Therefore, the goal post is a fixed obstruction placed in the midst of the playing area.

This conventional goal post construction is both a safety hazard to the players and an unwanted obstruction to the flow of the game. The presence of ground-anchored supports in the middle of the end-zone presents a serious hazard to the players on the field, because if a player runs into a support member at full speed he is liable to suffer serious injury. This hazard is especially dangerous to a defensive back who is easily led into the ground support by a receiver; it is also very dangerous to a receiver who can crash into a support because he must keep his eyes on the ball.

Furthermore, the location of the ground support in the middle of the end-zone interferes with the pattern of play in the game. For example, the ground support can be an obstruction to a receiver running his designated pass pattern and can upset the precise relationship between the quarterback and the receiver.

The uprights and cross-bar also obstruct the normal flow of the game because they are located in a plane extending directly over the goal line at a relatively low distance from the ground. Because of their location the uprights and cross-bar present a blocking surface against passes directed at a receiver located in the end-zone. It is not unusual for an end-zone directed pass to hit either the cross-bar or the uprights and, of course, if such a deflection occurs the play is unnecessarily obstructed. These members also present a blocking surface to a punter attempting to kick the ball out of the end-zone.

The goal post is only used when the offensive team is either kicking a field goal or an extra point; therefore, it is not necessary that it be in its target position over the goal line at all times of play and, in fact, at all other times a goal post hinders rather than assists the play of the game. It is an object of this invention to eliminate both the afore-mentioned hazardous and obstructive character of the present goal post by allowing the goal post to be moved out of target position when it is not needed.

Another shortcoming of conventional goal posts is that a single set is not adaptable to be used for both college and professional play each of which require different cross-bar widths. It is therefore an object of this invention to provide a single goal post which is adjustable for different dimensional requirements A further shortcoming in conventional goal posts is that the fact of the success or failure of a field goal or an extra point attempt must be determined solely by the visual judgment of the referee. The judgment factor includes the possiblity of an error which could vitally affect the outcome of a game. This shortcoming arises because the uprights contain no way of registering a score in response to a ball passing through and it is an object of this invention to provide a means for automatically registering a successful score. The goal posts according to this invention can also include means for visually registering other information in addition to a score such as other game data and advertisements.

In accordance with the present invention, a goal post is provided which overcomes all of the afore-mentioned difficulties. This goal post is anchored behind the end-zone in a position where it presents no real safety hazard to the players. The uprights and cross-bar can be pivoted out of an obstructing position when they are not needed as a field goal or extra point target. The crossbar is adjustable for different requirements. Furthermore, the goal post includes a detector for registering a successful field goal or extra point which is activated by the football passing through the uprights or means providing other visual registering of information to be transmitted to those in attendnce at the game.

In the embodiment of the invention disclosed herein, the goal post comprises a ground-anchored vertical support member and a pivotably attached upright and cross-bar boom extending toward the goal line and of sufficient length to allow the vertical support member to be planted in a non-hazardous position. A conventionally U-shaped cross-bar and upright configuration is located at the opposite end of the pivotable boom. When the boom is in its lowermost position, the cross-bar and uprights are in target position for field goals and extra points; however, when a target is not needed, the boom and cross-bar and uprights can be pivoted upwardly into a non-obstructing position.

The embodiment disclosed herein also includes a series of photocells on the inner face of each vertical upright. These photocells create a unidirectional photocell field which will be tripped by a football passing through the uprights from the field, but not by an object passing through the uprights in the opposite direction.

Other features and advantages of the invention will be apparent from the following description and claims are illustrated in the accompanying drawings which show structure embodying preferred features of the present invention and the principals thereof, and what is now considered to be the best mode in which to apply these principles.

BRIEF DESCRIPTION OF THE DRAWINGS

In the accompanying drawings forming a part of the specification, and in which like numerals are employed to designate like parts throughout the same:

FIG. 1 is a side view of a goal constructed according to the present invention;

FIG. 2 is the front view of the same goal post; and

FIG. 3 shows the inner face of one of the goal post uprights.

DETAILED DESCRIPTION OF THE PREFERRED EMBODIMENT

Figure 4:
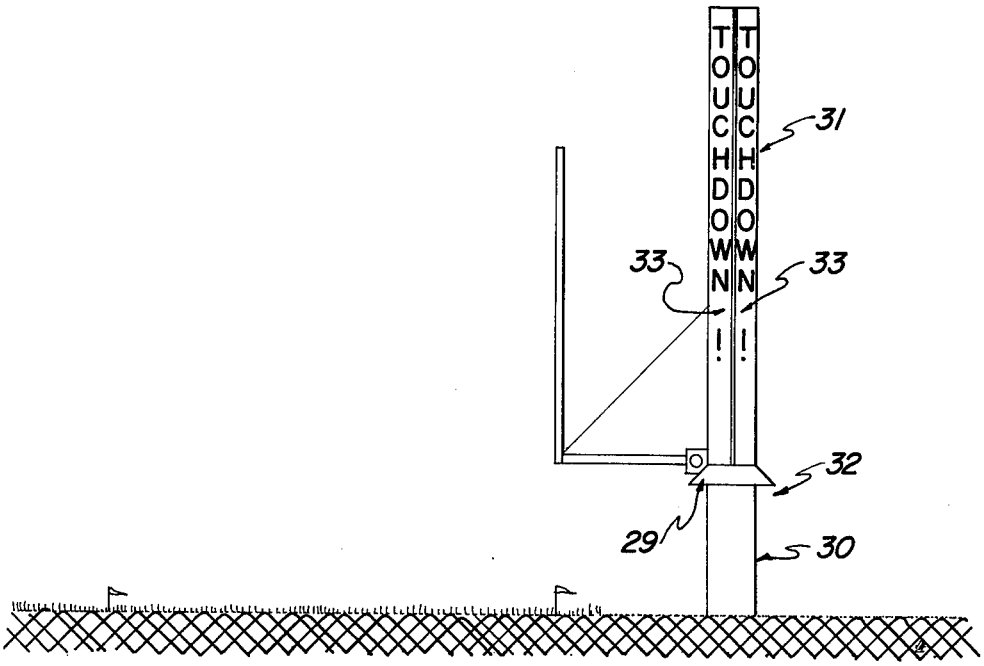
FIG. 4 discloses another embodiment of the invention with adjustable crossbar.

FIG. 1 shows the goal post and its relationship to the playing field. The vertical support member 10 is anchored at a safe distance behind the end-zone line 11. The support member 10 is preferably constructed of force resistant material, such as, a steel I-beam. The support 10 is surrounded by a cushioning and protective shield 12 around its base to give some added protection to the players and to protect the goal post from vandalism by the spectators to a game. A pivot support 13 is affixed to support 10 at about the required cross-bar height and contains boom pivot 14. An upright and cross-bar boom 15 is pivotably connected to support 13 and vertical support 10 by boom pivot 14. The upright and cross-bar boom 15 is of sufficient length to extend from the support 10 to a position directly over the goal line 11*a* when in its lowermost position. The upright and cross-bar boom 15 is pivoted upward through the operation of a motor 16, located at the of vertical support 10, acting on a steel (or equivalent) tension capable 17 affixed to the boom 15 at point 18. In the present embodiment, the motor is 5 hp. and is arranged for a cable speed of 60 fpm.

The uprights and cross-bar are affixed to the free end of boom 15.

FIG. 1 shows the boom 15 in its upright position 15' and demonstrates how when not required as a target the uprights and cross-bar can be moved to and kept in a non-obstructing location.

FIG. 2 shows the U-shaped cross-bar and upright configuration in greater detail. Cross-bar 19 is fixed horizontally at the free end of boom 15; it is of standard regualtion length and when the boom is in its lowermost position is ten feet above the goal line 11*a*. Uprights 20, 21, which can be in the form of elongated rectangularly cross-sectioned thermoplastic bars, extend vertically from the opposite ends of cross-bar 19 and can be of any desired height. In fact, the uprights of the present invention can be longer than those in conventional use to heighten the detection feature that will be subsequently described.

FIG. 3 discloses the inner face of upright 20 which contains two rows of photocells 22 and 23. The inner face of upright 21 (not shown) contains a corresponding array of photocells. The photocells are wired according to conventional methods so as to create a unidirectional photocell field system that will detect a football traveling from the playing field through the uprights. A football passing through the target will trip the field in proper sequence and activate the scoring register, exemplified in FIG. 2 at 25. The field is arranged so that an object traveling in the opposite direction will not activate the scoring register.

The response of the scoring register 25 can be delayed to accommodate the situation wherein the football passes through the uprights and then hits one of the members and bounces back toward the field; this would not be a score and would not register as one.

FIG. 4 discloses another embodiment of the present invention where the U-shaped cross-bar and upright configuration is adjustable between different dimensional requirements. For example, presently college rules require a 23'4" cross-bar and professional rules require a 18'6" cross-bar. Cross-bar 26 is telescopically adjustable between different widths and with uprights 27, 28 can conform to different required target sizes.

Figure 5:
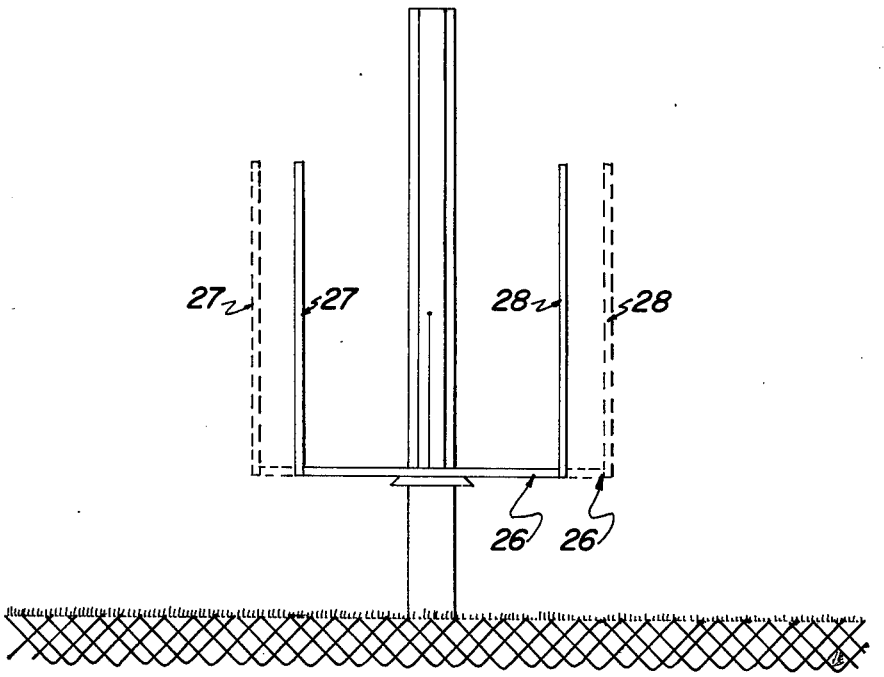
FIG. 5 is an embodiment of the invention including a vertical information matrix.

FIG. 5 discloses a side view of a goal post constructed according to the present invention including a vertical reading matrix message carrier which can be programmed to exhibit either game information, advertising or any other information of interest to those in attendance at a game. Goal post 29 contains a vertically extended support 30 which includes a vertical matrix message carrier portion 31 rising above trespass shield 32. The message carrier consists of light bulbs 33 arranged in vertical rows. Messages are projected on the carrier 31 by use of computer-control techniques known in the art which light up a matrix of bulbs to form the desired message. As is seen in FIG. 5 the message projected is "TOUCHDOWN" which reflects the action on the playing field.

The goal post constructed according to the present invention would operate in game conditions as follows:

1. the pivotable boom 15 normally would be positioned in its uppermost position where it does not obstruct the flow of the game;
2. when cross-bar and uprights are needed for a field goal or extra point attempt the boom can be activated from the field and lowered to its target position, the cross-bar and uprights can be adjusted to either professional or college widths;
3. if the kick passes through the uprights, then the photocell field is activated and the score is registered and if it does not pass through the field, of course, no score will be registered;
4. after the kick attempt the cross-bar and uprights can be pivotable raised back to their non-obstructing position; and p0 5. at desired times information can be relayed to those watching the game by the vertical matrix message carrier.

Thus, while preferred constructional features of the invention are embodied in the structure illustrated herein; it is to be understood that changes and variations may be made by those skilled in the art without departing from the spirit and scope of the appended claims.

What is claimed is:

1. A football goal post for use as a field goal and extra point scoring target comprising:

a horizontal bar with two vertically directed bars attached to said horizontal bar and forming a U-shaped target means and wherein said horizontal bar is adapted for adjustment between different lengths to form different size U-shaped target means;

goal post support means adapted for anchoring to the ground;

an elongated boom pivotably connected to said goal post support means at one end and connected to the horizontal bar of U-shaped target means at its opposite end and having a first position wherein said U-shaped target means is in its scoring target position;

means for pivoting said boom about its pivotable connection to said goal post support means to a second position at an angle above the horizontal; and vertical reading message matrix extending from said goal post support means including rows of lights operationally controlled by computer program to form desired message.

2. A football goal post comprising:

a horizontal bar with two vertically directed bars attached to said horizontal bar and forming a U-shaped target means;

goal post support means adapted for anchoring to the ground; and vertical reading meassage matrix extending from said goal post support means including rows of lights operationally controlled by computer program to form desired message.

* * * * *

UNITED STATES PATENT AND TRADEMARK OFFICE

CERTIFICATE OF CORRECTION

PATENT NO. : 4026554

DATED : May 31, 1977

INVENTOR(S) : George E. Karkoska

It is certified that error appears in the above-identified patent and that said Letters Patent are hereby corrected as shown below:

Column 3, Line 6--add the word "post" between the word "goal" and the word "constructed"

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*